US007570256B2

(12) United States Patent
Han

(10) Patent No.: US 7,570,256 B2
(45) Date of Patent: Aug. 4, 2009

(54) APPARATUS AND METHOD FOR TRANSMITTING DATA OF IMAGE DISPLAY DEVICE

(75) Inventor: Sang Soo Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 645 days.

(21) Appl. No.: 11/316,976

(22) Filed: Dec. 27, 2005

(65) Prior Publication Data

US 2006/0267900 A1 Nov. 30, 2006

(30) Foreign Application Priority Data

May 11, 2005 (KR) ..... 10-2005-0039400

(51) Int. Cl.
*G09G 3/36* (2006.01)

(52) U.S. Cl. ..... 345/204; 345/87; 345/98; 345/100; 345/205; 345/207; 345/209

(58) Field of Classification Search ..... 345/87, 345/98, 204, 205, 208, 501, 520, 522, 540; 348/441

See application file for complete search history.

(56) References Cited

U.S. PATENT DOCUMENTS

| | | | | |
|---|---|---|---|---|
| 6,147,672 | A * | 11/2000 | Shimamoto | 345/589 |
| 6,774,903 | B1 * | 8/2004 | Glen | 345/535 |
| 6,877,050 | B2 * | 4/2005 | Kanzaki et al. | 710/100 |
| 6,909,418 | B2 * | 6/2005 | Arai | 345/98 |
| 2002/0196688 | A1 * | 12/2002 | Ernst et al. | 365/201 |
| 2005/0219235 | A1 * | 10/2005 | Fukuo | 345/204 |

* cited by examiner

*Primary Examiner*—Bipin Shalwala
*Assistant Examiner*—Vince E Kovalick
(74) *Attorney, Agent, or Firm*—Holland & Knight LLP

(57) ABSTRACT

An apparatus for transmitting data of an image display device includes an image display part equipped with sub-pixels formed between gate lines and data lines, a data driver for driving the data lines of the image display part, a gate driver for driving the gate lines of the image display part, and a timing controller for controlling operations of the data driver and the gate driver, generating a data inversion signal using an transmitted data signal and the next data signal, switching the data inversion signal when the data inversion signal has a logic state successively maintained at least two times, and transmitting one of the next data signal and the inverted next data signal depending on the data inversion signal.

11 Claims, 7 Drawing Sheets

APPARATUS AND METHOD FOR TRANSMITTING DATA OF IMAGE DISPLAY DEVICE

This application claims the benefit of the Korean Patent Application No. P2005-39400, filed on May 11, 2005, which is hereby incorporated by reference in its entirety.

BACKGROUND OF THE INVENTION

1. Field of the Invention

The present invention relates to an image display device, and more particularly, to an apparatus and method for transmitting data of an image display device. Although the present invention is suitable for a wide scope of applications, it is particularly suitable for minimizing the number of data transitions simultaneously while reducing power consumption.

2. Discussion of the Related Art

The amount of video data transmitted via a transmission medium has rapidly increased to satisfy the demand of users who desire to view high-quality video data. The high-quality video data is transmitted to users at high speed, such that the users can use the high-quality video data. Therefore, transmission frequency of video data has gradually increased, and the number of transmission lines capable of transmitting the video data has also increased. If video data having a high frequency is transmitted over data transmission lines in which the transmissions become synchronized, Electromagnetic Interference (EMI) can occur. To reduce the occurrence of the EMI, an image display device typically either uses a first method of reducing the number of data transitions according to a data modulation scheme, or a second method of reducing transmission frequency using six-bit data into two ports.

FIG. 1 is a circuit diagram illustrating a related art image display device for transmitting video data using six-bit data into two ports. As shown in FIG. 1, the image display device includes an image display part 10 for displaying a desired image, a data driver 20 for driving data lines (DL1~DLm) of the image display part 10, a gate driver 30 for driving gate lines (GL1~GLn) of the image display part 10, and a timing controller 40 for controlling the data driver 20 and the gate driver 30. The image display part 10, includes a pixel matrix composed of sub-pixels formed between the gate lines and the data lines.

A single pixel is implemented by a combination of red, green and blue sub-pixels. Each sub-pixel includes a pixel cell 12 for displaying a desired image according to a data signal applied to the data line, such that it establishes synchronization with a scan pulse applied to a corresponding gate line. The pixel cell 12 may be a liquid crystal cell for adjusting an optical transmission rate according to the data signal to display a desired image, or a light emitting cell for performing light emission according to a current signal corresponding to the data signal to display a desired image.

The gate driver 30 includes a plurality of gate driver integrated circuits (ICs) for independently driving the gate lines (GL1~GLn) of the image display device 10. Individual gate driver ICs sequentially transmit scan pulses to the gate lines (GL1~GLn), such that the gate lines (GL1~GLn) are sequentially driven. The data driver 20 includes a plurality of data driver ICs for independently driving data lines (DL1~DLm) of the image display device 10. Each data driver IC converts a digital data signal (Data) received from the timing controller 40 into an analog data signal, such that the analog data signal is applied to individual data lines (DL1~DLm) whenever receiving the scan pulse.

The timing controller 40 generates a gate control signal (GCS) capable of controlling the gate driver 30, and transmits the gate control signal (GCS) to the gate driver 30. The timing controller 40 generates a data control signal (DCS) capable of controlling the data driver 20, and transmits the data control signal (DCS) to the data driver 20. In this case, the timing controller 40 receives a data enable signal (DE) indicative of a valid data interval, a horizontal synchronous signal (Hsync), a vertical synchronous signal (Vsync), a dot clock (DCLK) for determining a transmission frequency of video data (RGB) from a drive system (not shown), and generates gate control signals (GCS) and data control signals (DCS) using the received signals.

The timing controller 40 arranges a source data signal (RGB) received from the drive system (not shown) according to a two-port transmission scheme, and transmits the arranged source data signal to the data driver 20. For example, the timing controller 40 divides the source data signal (RGB) into an odd data signal (OData) and an even data signal (EData), and transmits the odd data signal (OData) and the even data signal (EData) to the data driver 20 via two ports, respectively.

Provided that each source data (RGB) is composed of 6-bit data to represent 63 gray levels, the above-mentioned two ports for transmitting the odd data signal (Odata) and the even data signal (Edata) in parallel to each other include a total of 36 data transmission lines (i.e., RO0~RO5, RE0~RE5, GO1~G05, GE0~GE5, BO1~BO5, and BE0~BE5). In this way, the timing controller 40 uses the two-port transmission scheme to reduce a transmission frequency of a data signal, resulting in a reduction of EMI.

FIG. 2 is a circuit diagram illustrating a related art data transmitter. As shown in FIG. 2, according to the above-mentioned data transmission method via two ports, the timing controller 40 (1) compares a current data signal with the next data signal to detect the number of data transitions, (2) forms a data inversion signal (REV) according to the detected number of transitions, (3) arranges a data signal to be synchronized with the data inversion signal (REV), (4) transmits the arranged data signal to the data driver 20 and the data driver 20 (5) re-arranges the data signal received from the timing controller 40 such that the re-arranged data signal is synchronized with the data inversion signal (REV) received from the timing controller 40, (6) the data inversion signal (REV) is also transmitted to the data driver 20, and (7) the data driver 20 uses the received REV signal to determine whether the received data was inverted of the timing controller 40 or whether the transmitted data signal was transmitted by the timing controller 40.

FIG. 3 is a waveform diagram illustrating drive waveforms of the data transmitter shown in FIG. 2. As shown in FIG. 3, if the timing controller 40 transmits a white signal to the data driver 20, the TC 40 (1) receives an transmitted data signal having the value of "1", and (2) forms a data signal having the value of zero synchronized with the data inversion signal of 1, and transmits the transformed data signal of zero to the data driver 20. In this case, although the transformed data signal of 0 is continuously applied to the data driver 20, the data inversion signal (REV) is maintained at the value of "1", such that the original data signal is inverted by the timing controller 40, and the received data signal is re-inverted by the data driver 20.

In the meantime, it is well known to those skilled in the art that there is little variation in gray levels due to similarity between adjacent data signals of an image to be displayed on the image display part 10. However, it should be noted that a single gray variation in a binary code corresponding to video data does not always mean transition of 1-bit data. For example, if a first port transmits a signal of "000111" corresponding to grey level 7 as an i-th red data signal, and then transmits a signal of "001000" corresponding to grey level 8 as an (i+2)-th red data signal, it can be recognized that there are relatively many bit transitions (i.e., four-bit transitions) even though only one grey level between the i-th red data signal and the (i+2)-th red data signal is changed.

The above-mentioned data transmission method via two ports forms unnecessary data transition in the timing controller 40 and the data driver 20. In this case, the number of data transitions provided when a 6-bit data signal corresponding to a white signal is transmitted to the image display having XGA resolution using a 2-port transmission method during a predetermined period of time equal to a one horizontal interval is denoted by 6×3×2×256 equal to 9216 times. In this case, 256 is indicative of the number of data signals applied to a single data driver. Therefore, although most data transmission lines of two ports successively transmit adjacent data signals having little gray variation, many data bits transisitions are formed on individual data transmission lines, resulting in increased EMI and power consumption.

SUMMARY OF THE INVENTION

Accordingly, the present invention is directed to an apparatus and method for transmitting data of an image display device that substantially obviates one or more problems due to limitations and disadvantages of the related art.

An object of the present invention is to provide an apparatus and method for transmitting data of an image display device so as to minimize both the number of data transitions.

Another object of the present invention is to provide an apparatus and method for transmitting data of an image display device so as to minimize power consumption Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for transmitting data of an image display device includes an image display part equipped with sub-pixels formed between gate lines and data lines, a data driver for driving the data lines of the image display part, a gate driver for driving the gate lines of the image display part, and a timing controller for controlling operations of the data driver and the gate driver, generating a data inversion signal using an transmitted data signal and the next data signal, switching the data inversion signal when the data inversion signal has a logic state successively maintained at least two times, and transmitting one of the next data signal and the inverted next data signal depending on the data inversion signal.

In another aspect of the present invention, there is provided a method for transmitting data of an image display device which includes an image display part equipped with sub-pixels formed between gate lines and data lines, and a data driver for driving the data lines of the image display part, the method including the steps of: a) arranging an input source data signal to operate the image display by generating an arranged next data signal, b) generating a data inversion signal using the arranged next data signal and a transmitted data signal applied to the data driver, c) performing transition of the next data signal according to the data inversion signal, and transmitting the transition result to the data driver, and d) inverting the data inversion signal when the data inversion signal has a logic state successively maintained at least two times, and transmitting the transmitted data signal to the data driver.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
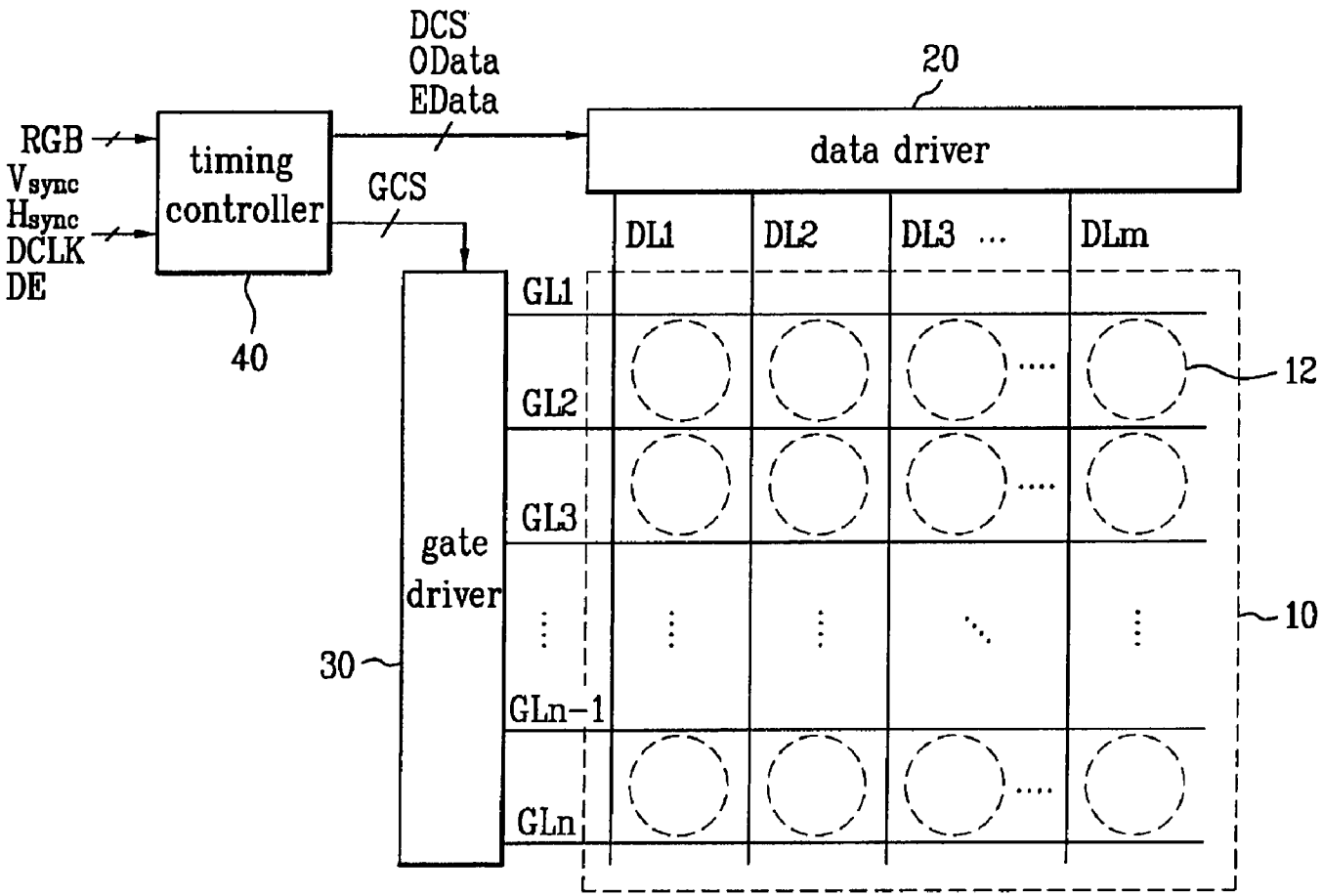
FIG. 1 Related Art
FIG. 1 is a circuit diagram illustrating a related art image display device.
Figure 2:
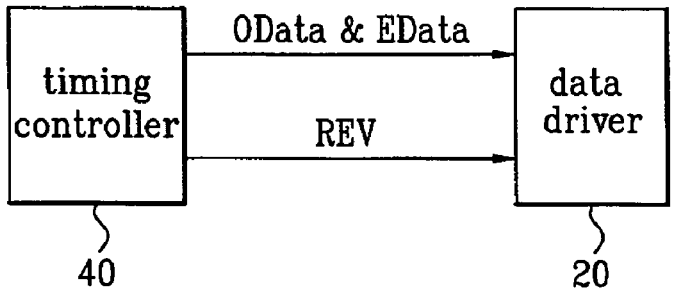
FIG. 2 Related Art
FIG. 2 is a circuit diagram illustrating a related art data transmitter.
Figure 3:
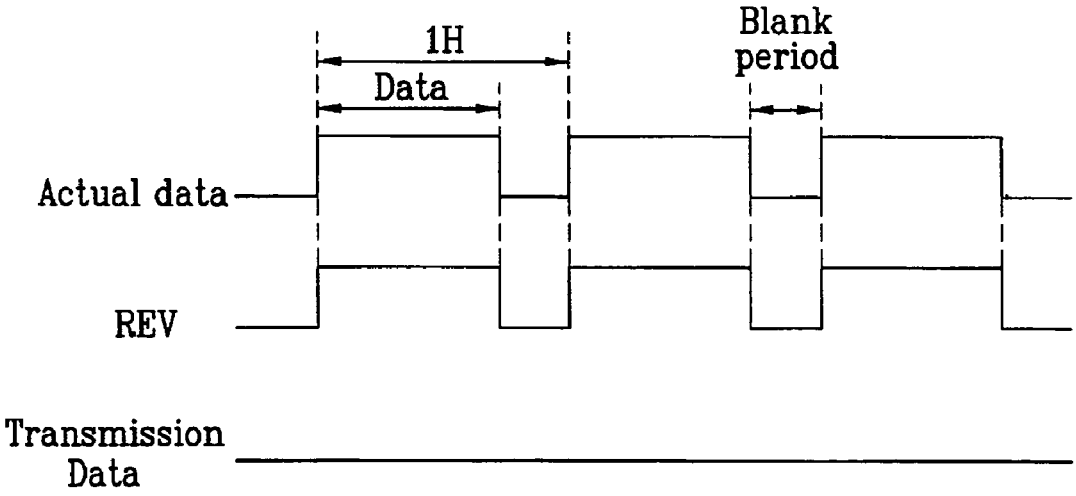
FIG. 3 Related Art
FIG. 3 is a waveform diagram illustrating drive waveforms of the data transmitter shown in FIG. 2.
Figure 4:
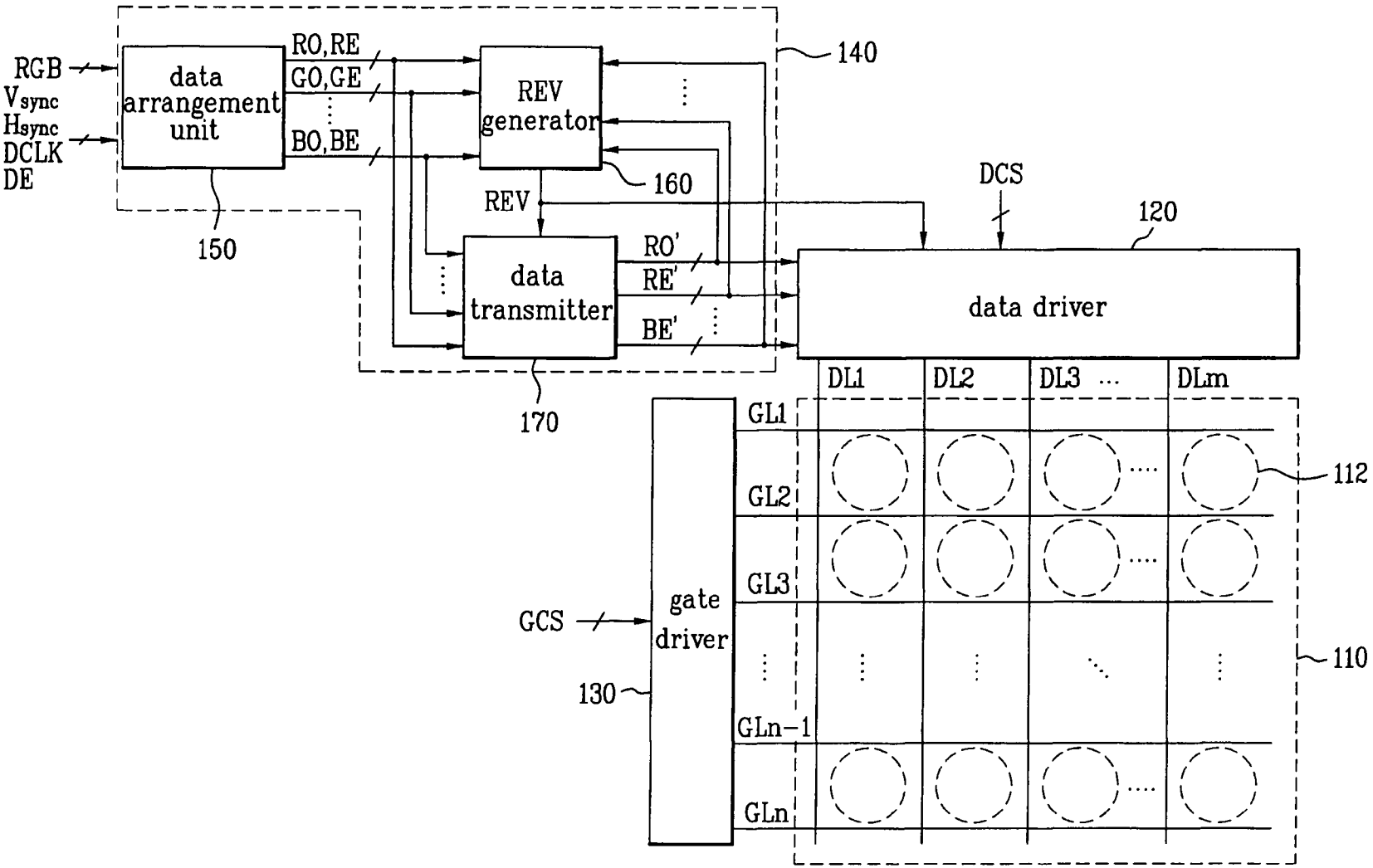
FIG. 4 is a waveform diagram illustrating a data transmitter of an image display device according to an embodiment of the present invention.

FIG. 4 is a waveform diagram illustrating a data transmitter of an image display device according to an embodiment of the present invention. As shown in FIG. 4, the data transmitter used in the image display device according to embodiments of the present invention includes an image display part 110 for displaying a desired image, a data driver 120 for driving data lines (DL1~DLm) of the image display part 110, a gate driver 130 for driving gate lines (GL1~GLn) of the image display part 110, and a timing controller 140 for controlling the data driver 120 and the gate driver 130, generating a data inversion signal (REV) upon receipt of an transmitted data signal and the next data signal, and transmitting the transmitted data signal to the data driver 120 when the data inversion signal (REV) successively maintains a logic state at least two times.

The image display part 110 includes a pixel matrix composed of sub-pixels formed at individual crossings of the gate lines and the data lines. A single pixel is implemented by continuing RGB sub-pixels. Each sub-pixel includes a pixel 112 for displaying a desired image according to a data signal applied to the data line, such that it establishes synchronization with a scan pulse applied to a corresponding gate line. In this case, the pixel 112 may be determined to be a liquid crystal cell for adjusting an optical transmission rate according to the data signal to display a desired image, or a light emitting cell for performing light emission according to a current signal corresponding to the data signal to display a desired image.

The gate driver 130 includes a plurality of gate driver integrated circuits (ICs) for independently driving the gate lines (GL1~GLn) of the image display part 110. Individual gate driver ICs sequentially transmit scan pulses to the gate lines (GL1~GLn), such that the gate lines (GL1~GLn) are sequentially driven. The data driver 120 includes a plurality of data driver ICs for independently driving data lines (DL1~DLm) of the image display part 110. Each data driver IC converts a digital data signal (RO0'~BE5') received from the timing controller 140 into an analog data signal, such that the analog data signal is applied to individual data lines (DL1~DLm) whenever receiving the scan pulse.

The timing controller 140 generates a gate control signal (GCS) capable of controlling the gate driver 130, and transmits the gate control signal (GCS) to the gate driver 130. The timing controller 140 generates a data control signal (DCS) capable of controlling the data driver 120, and transmits the data control signal (DCS) to the data driver 120. In this case, the timing controller 140 receives a data enable signal (DE) indicative of a valid data interval, a horizontal synchronous signal (Hsync), a vertical synchronous signal (Vsync), a dot clock (DCLK) for determining a transmission frequency of video data (RGB) from a drive system (not shown), and generates gate control signals (GCS) and data control signals (DCS) using the received signals.

The timing controller 140 arranges a source data signal (RGB) received from the drive system (not shown) according to a two-port transmission scheme, and transmits the arranged source data signal to the data driver 120. For example, the timing controller 140 divides the source data signal (RGB) into an odd data signal (RO, GO, and BO) and an even data signal (RE, GE, and BE), and transmits the odd data signal (RO, GO, and BO) and the even data signal (RE, GE, and BE) to the data driver 120 via two ports, respectively. In an embodiment, each source data (RGB) is composed of 6-bit data to represent 63 gray levels. The above-mentioned two ports for transmitting the odd data signal (RO, GO, and BO) and the even data signal (RE, GE, and BE) in parallel to each other include a total of 36 data transmission lines (i.e., RO0~RO5, RE0~RE5, GO~GO5, GE0~GE5, BO~BO5, and BE0~BE5). In this way, the timing controller 140 uses the two-port transmission scheme to reduce a transmission frequency of a data signal, resulting in a reduction of electromagnetic interference (EMI)

For this purpose, the timing controller 140 includes a data arrangement unit 150 for arranging the source data signal (RGB) received from the drive system in the form of odd and even data signals (RO, GO, BO, RE, GE, and BE); a REV generator 160 for generating a data inversion signal (REV) using not only the next odd and even data signal (RO, GO, BO, RE, GE, and BE) received from the data arrangement unit 150, but also previously transmitted odd and even data signals (RO', GO', BO', RE', GE', and BE') applied to the data driver 120; and a data transmitter 170 for performing inversion of the next odd and even data signals (RO, GO, BO, RE, GE, and BE) received from the data arrangement unit 150 upon receiving the data inversion signal (REV) from the REV generator 160, and transmitting the inverted resulting signal to the data driver 120. In this case, a data signal generated from the data arrangement unit 150 is referred to as the next data signal, and a data signal applied from the data transmitter 170 to the data driver 120 is referred to as a transmitted data signal.

The data arrangement unit 150 arranges a source data signal (RGB) received from the drive system to operate the image display part 110, RGB in the form of the odd and even data signals (RO, GO, BO, RE, GE, and BE), and transmits the arranged data signals (RO, GO, BO, RE, GE, and BE) to the REV generator 160 and the data transmitter 170.

Figure 5:
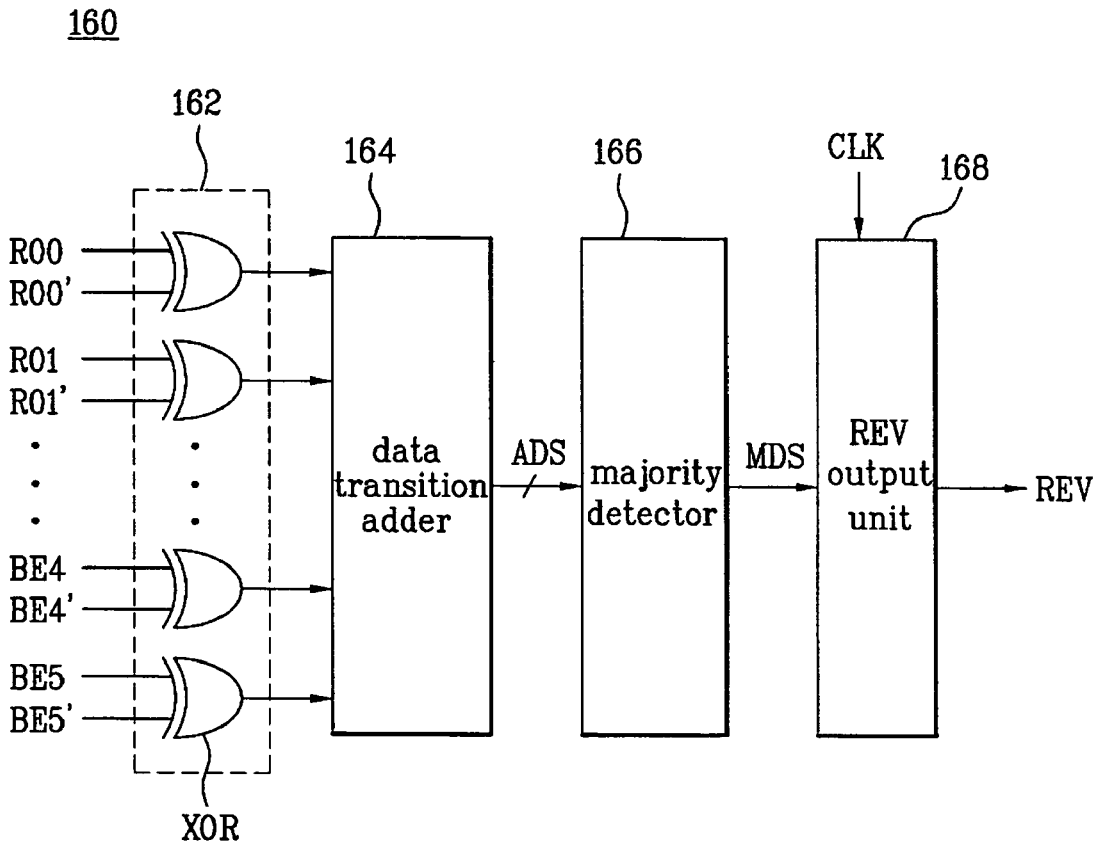
FIG. 5 is a circuit diagram illustrating an REV generator shown in FIG. 4 according to an embodiment of the present invention.

FIG. 5 is a circuit diagram illustrating a REV generator shown in FIG. 4 according to an embodiment of the present invention. As shown in FIG. 5, the REV generator 160 includes a data transition check unit 162, a data transition adder 164, a majority detector 166, and a REV output unit 168. The data transition check unit 162 detects the presence or absence of data for example transitions between the next data signals (RO, GO, BO, RE, GE, and BE) received from the arrangement unit 150 and transmitted data signals (RO', GO', BO', RE', GE', and BE') received from the data transmitter 170. The data transition adder 164 calculates the number of transitions ADS received from the data transition check unit 162. The majority detector 166 determines whether the number of transitions signal (ADS) received from the data transition adder 164 is greater than half of the number of all data signals and outputs a majority detection signal (MDS). The REV output unit 168 generates a data inversion signal (REV) according to the majority detection signal (MDS) received from the majority detector 166, and outputs the generated data inversion signal (REV).

The data transition check unit 162 includes a plurality of XOR gates for performing an exclusive-OR (XOR) operation between the next data signals (RO, GO, BO, RE, GE, and BE) and the data signals (RO', GO', BO', RE', GE', and BE'), respectively. In an embodiment, the data transition check unit 162 includes 36 XOR gates when the number of bits in the data signal is 6 (i.e., 6 bits), and it is assumed that the data signal is indicative of 6-bits data signal for the convenience of description. Individual next data signals (RO, GO, BO, RE, GE, and BE) are applied to individual first input terminals of individual XOR gates, respectively. Individual transmitted data signals (RO', GO', BO', RE', GE', and BE') are applied to individual second input terminals of individual XOR gates, respectively. Individual XOR gates output data transition signals, each of which has a logic state of "1", when data transition occurs in the next data signals (RO, GO, BO, RE, GE, and BE) and the transmitted data signal, (RO', GO', BO', RE', GE', and BE'). Otherwise, if no data transition occurs in the next data signals (RO, GO, BO, RE, GE, and BE) and the transmitted data signal, (RO', GO', BO', RE', GE', and BE'), individual XOR gates output data transition signals, each of which has a logic state of "0".

The data transition adder 164 calculates the sum of 36 data transition signals received from the data transmission check unit 162. In other words, the data transition adder 164 selects data transition signals, each of which has a logic state of "1", from among 36 data transition signals received from the data transition check unit 162, and calculates the number of the selected data transition signals. For this purpose, the data transition adder 164 includes six 6-bit binary adders.

The majority detector 166 determines whether the number of transitions signal (ADS) received from the data transmission adder 164 is higher than half of the total number of RGB data pieces (i.e., 36 RGB data pieces), to generate a majority detection signal (MDS). In this case, if the number of transitions signal is higher than 18, the majority detector 166 outputs a majority detection signal (MDS) having a logic state of "1". Otherwise, 166 outputs a majority detection signal (MDS) having a logic state of "0".

The REV output unit 168 generates a data inversion signal (REV) using the majority detection signal (MDS) received from the majority detector 166. If the generated data inversion signal (REV) has a logic level successively maintained at least two times, the REV output unit 168 inverts/outputs the data inversion signal (REV) to transmit the transmitted data signal to the data driver 120.

Figure 6:
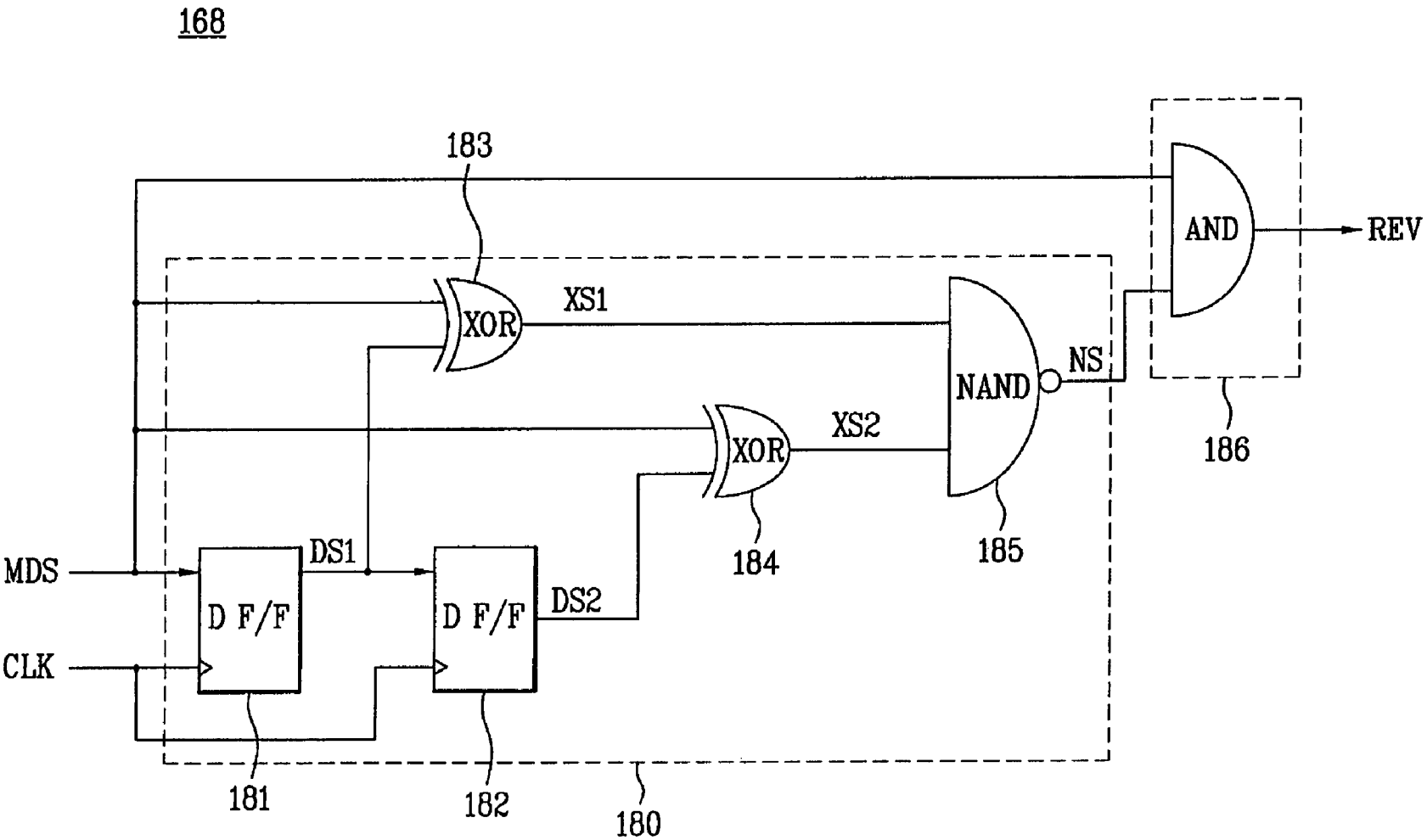
FIG. 6 is a circuit diagram illustrating a REV output unit shown in FIG. 5.

FIG. 6 is a circuit diagram illustrating a REV output unit shown in FIG. 5 according to an embodiment of the present invention. As shown in FIG. 6, the REV output unit 168 includes a check unit 180 and an output 186. The check unit 180 determines whether a logic state of the majority detection signal (MDS) occurs at least two consecutive times, or at least twice in a three time period, using the clock signal (CLK) and the majority detection signal (MDS) and outputs a clock signal. The output unit 186 generates a data inversion signal (REV) according to the majority detection signal (MDS) and the check signal (NS), and the data and outputs the data inversion signal (REV) to the data transmitter 170 (shown in FIG. 4).

The check unit 180 includes a first delay 181 for delaying the majority detection signal (MDS) according to the clock signal (CLK); a second delay 182 for delaying an output signal (DS1) received from the first delay 181 according to the clock signal (CLK); a first XOR gate 183 for performing an XOR operation between the output signal (DS1) of the first delay 181 and the majority detection signal (MDS); a second XOR gate 184 for performing an XOR operation between the output signal (DS2) of the second delay 182 and the majority detection signal (MDS); and a NAND gate 185 for performing a NAND operation of individual output signals XS1 and XS2 of the first and second XOR gates 183 and 184, and generating the check signal (NS). In this case, the clock signal (CLK) may have the same period as that of a source shift clock (SSC), or may be equal to the source shift clock (SSC).

The above-mentioned check unit 180 delays the majority detection signal (MDS) by 2 clock pulses using the first and second delays 181 and 182, performs an XOR operation between each delay signal DS1 or DS2 and the majority detection signal (MDS), performs a NAND operation of the XOR-operation signal, and forms the check signal (NS). The output unit 186 performs an AND operation between the check signal (NS) received from the NAND gate 185 and the majority detection signal (MDS), generates a data inversion signal (REV), and transmits the formed data inversion signal (REV) to the data transmitter 170. Thus, the REV output unit 168 inverts the data inversion signal (REV), and transmits the inverted data inversion signal to the data transmitter 170, such that it can transmit an transmitted data signal to the data driver 120 when a logic level of the majority detection signal (MDS) is maintained at least two consecutive times or has the same value at least twice in three time periods. The data transmitter 170 shown in FIG. 4 performs inversion of the odd and even data signals (RO, GO, BO, RE, GE, and BE) received from the data transmitter 150 according to the data inversion signal (REV) received from the REV output unit 168, and transmits the inverted result to the data driver 120.

Figure 7:
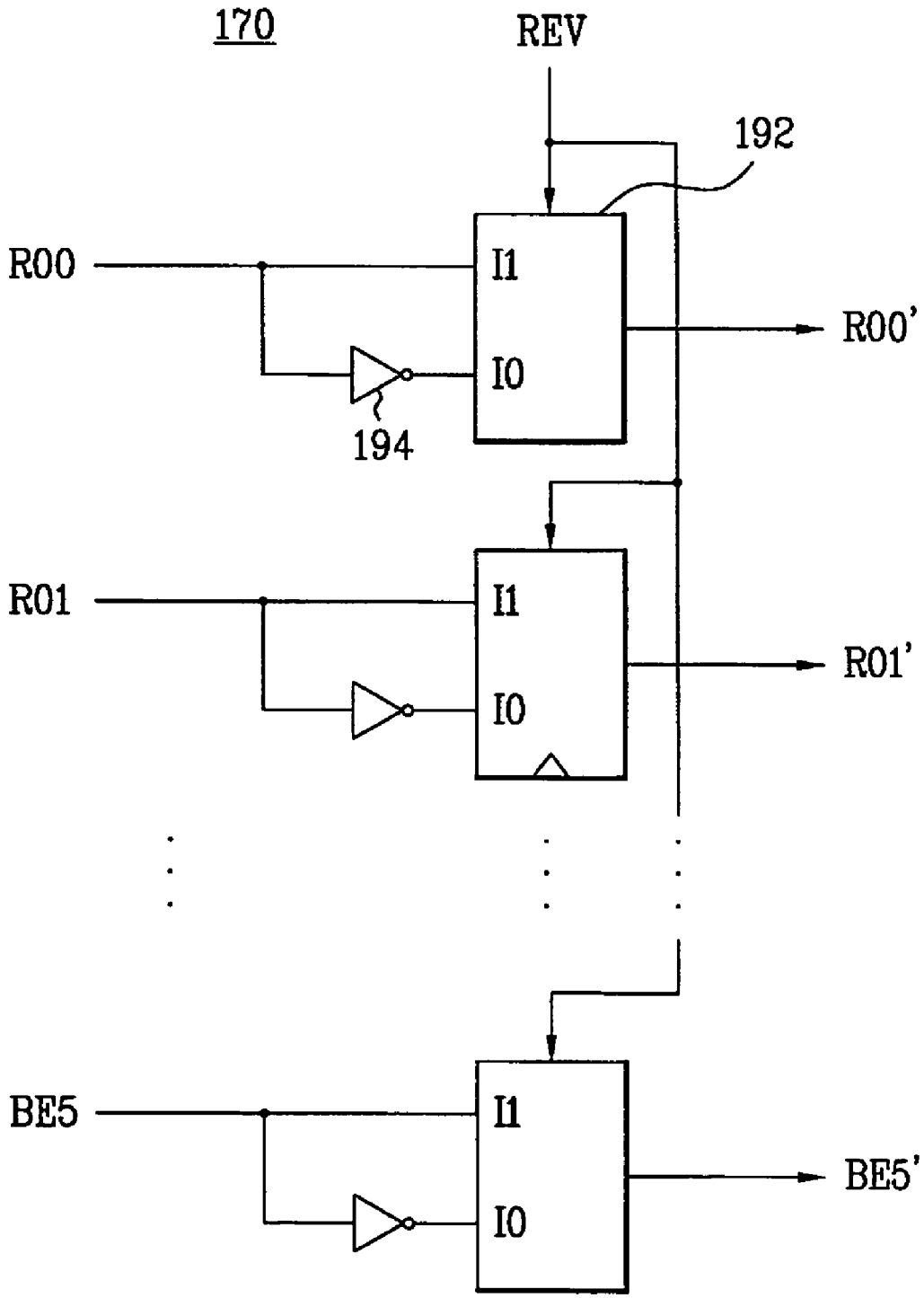
FIG. 7 is a circuit diagram illustrating a data transmitter shown in FIG. 4.

FIG. 7 is a circuit diagram illustrating a data transmitter shown in FIG. 4 according to an embodiment of the present invention. As shown in FIG. 7, the data transmitter 170 includes 36 multiplexers 192 for performing transition of individual data signals (RO0~RO5, RE0~RE5, GO~GO5, GE0~GE5, BO~BO5, and BE~BE5) received from the data arrangement unit 150 according to the data inversion signal (REV). Each multiplexer 192 includes a first input terminal I1 connected to a data transmission line via which signals (RO0~RO5, RE0~RE5, GO1~GO5, GE~GE5, BO~BO5, or BE0~BE5) are transmitted from the data arrangement unit 150; a second input terminal I0 connected to a data transmission line via an inverter 194; and a control signal input terminal for receiving the data inversion signal (REV) from the REV output unit 168. In this case, the output unit 186 of the REV output unit 168 may be provided within the data transmitter 170, such that it can be connected to the individual multiplexers 192.

Each multiplexer 192 outputs a transmitted data signal received from the first input terminal I1 to the data driver 120 when the data inversion signal (REV) has a logic state of "1", and outputs an inverted data signal received from the second input terminal I0 to the data driver 120 when the data inversion signal (REV) has a logic state of "0". Therefore, the data transmitter 170 inverts an input data signal to reduce the number of data transitions when the number of data transitions is higher than half of the overall data lines, so that output data signals denoted by (36—(data transition amount of at least 18)) are inverted. Furthermore, the data transmitter 170 prevents a signal from being inverted by the timing controller 140 whenever the REV output unit 168 does not successively provide a logic state of "1" at least two times, and also prevents the signal from being re-inverted by the data driver 120.

Figure 8:
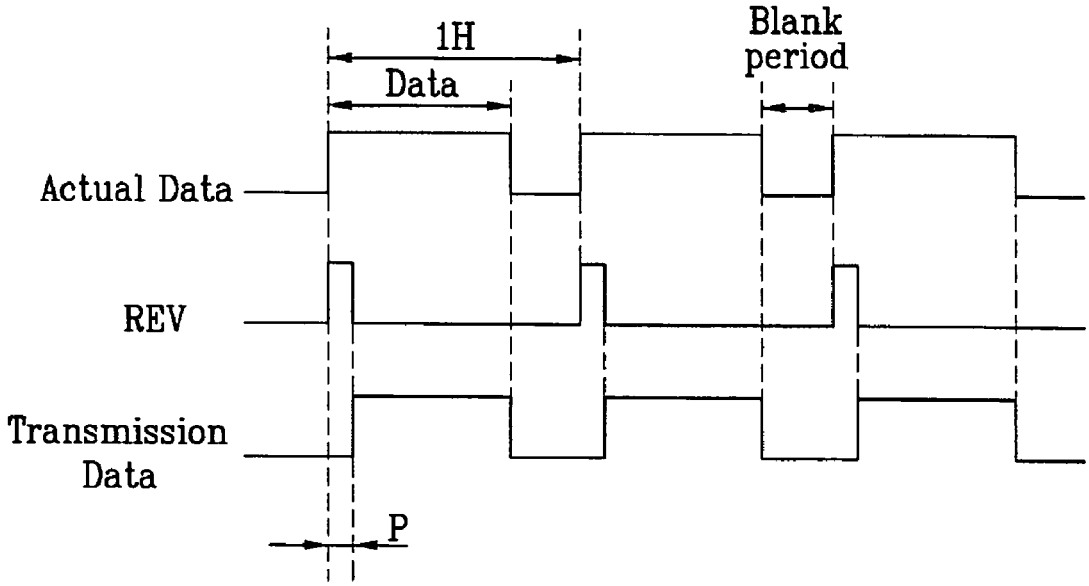
FIG. 8 is a waveform diagram illustrating drive waveforms of the data transmitter shown in FIG. 4.

FIG. 8 is a waveform diagram illustrating drive waveforms of the data transmitter shown in FIG. 4 according to an embodiment of the present invention. As shown in FIG. 8, if the timing controller 140 has to transmit a white signal to the data driver 120, the REV output unit 168 receives an transmitted data signal having a logic state of "1", such that it generates/outputs a data inversion signal (REV) having the logic state of "1". Therefore, the data transmitter 170 generates a data signal having a logic state of "0" according to the data inversion signal (REV) having a logic state of "1", and transmits the transmitted data signal to the data driver 120.

In this case, if the data inversion signal (REV) having a logic state of "1" is generated during a predetermined period of time corresponding to 2 clock (CLK) signals, the REV output unit 168 switches the data inversion signal (REV) to a logic state of "0" as shown in a point "P" of FIG. 8, and outputs the inverted data signal having the logic state of "0". Therefore, the data transmitter 170 outputs an transmitted data signal only once, and outputs the transmitted data signal without any change.

The apparatus and method for transmitting data of the image display device according to embodiments of the present invention prevents unnecessary data transition from being generated in the timing controller 140 and the data driver 120. For example, if a 6-bit data signal corresponding to a white signal is transmitted to the image display unit having XGA resolution according to the 2-port transmission scheme during a single horizontal interval, the number of data transitions is denoted by $6\times3\times2\times2+6\times3\times2\times1$ (i.e., 108 times). Therefore, the apparatus and method for transmitting data of the image display device according to embodiments of the present invention minimizes the number of data transitions although most data transmission lines of two ports successively transmit adjacent data signals having little gray variation, resulting in reduction of EMI and power consumption.

As apparent from the above description, the apparatus and method for transmitting data of the image display device according to embodiments of the present invention inverts a data inversion signal when the data inversion signal for reducing the number of data transitions has a logic state successively maintained at least two times, and outputs a transmitted data signal by the inversion of the data inversion signal, such that it prevents unnecessary data transitions from being generated in the timing controller and the data driver, resulting in minimum of data transitions and minimum power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for transmitting data of an image display device comprising:

an image display part equipped with sub-pixels formed between gate lines and data lines;

a data driver for driving the data lines of the image display part;

a gate driver for driving the gate lines of the image display part; and a timing controller for controlling operations of the data driver and the gate driver, generating a data inversion signal using an transmitted data signal and the next data signal, switching the data inversion signal when the data inversion signal has a logic state successively maintained at least two times, and transmitting one of the next data signal and the inverted next data signal depending on the data inversion signal, wherein the timing controller includes:

a data arrangement unit for arranging an external source data signal to operate the image display part;

a data inversion signal generator for generating the data inversion signal using the next data signal received from the data arrangement unit and a transmitted data signal applied to the data driver; and a data transmitter for performing inversion of the next data signal received from the data arrangement unit according to the data inversion signal, and transmitting the inverted resulting signal to the data driver and the data inversion signal generator, wherein the data inversion signal generator includes:

a data transition check unit for detecting the presence or absence of transitions of the next data signal and transitions of the transmitted data signal;

a data transition adder for calculating the sum of the number of transitions received from the data transition check unit;

a detector for determining whether the sum value received from the data transition adder is higher than a reference value, and generating a detection signal according to the determined result; and a data inversion signal output unit for generating the data inversion signal using the detection signal.

2. The apparatus according to claim 1, wherein the reference value is equal to half of a total number of overall bits of the data signal.

3. The apparatus according to claim 1, wherein the data inversion signal output unit includes:

a check unit for determining whether a logic state of the detection signal is maintained at least two times using a clock signal and the detection signal, and generating a check signal according to the determined result; and an output unit for generating the data inversion signal according to the detection signal and the check signal, and transmitting the data inversion signal to the data transmitter.

4. The apparatus according to claim 3, wherein the check unit includes:

a first delay for delaying the detection signal according to the clock signal, and outputting the delayed result;

a second delay for delaying an output signal of the first delay according to the clock signal, and outputting the delayed result;

a first XOR gate for performing an XOR operation between the output signal of the first delay and the detection signal, and outputting the XOR-operation result;

a second XOR gate for performing an XOR operation between the output signal of the second delay and the detection signal, and outputting the XOR-operation result;

a NAND gate for performing a NAND operation of individual output signals of the first and second XOR gates, and generating the check signal.

5. The apparatus according to claim 4, wherein the output unit performs an AND operation between the detection signal and the check signal to form the data inversion signal, and transmits the data inversion signal to the data transmitter.

6. The apparatus according to claim 1, wherein the data arrangement unit divides the arranged data signal into odd data signals and even data signals, and arranges the odd and even data signals.

7. A method for transmitting data of an image display device which includes an image display part equipped with sub-pixels formed between gate lines and data lines, and a data driver for driving the data lines of the image display part, the method comprising:

a) arranging an input source data signal to operate the image display by generating an arranged next data signal;

b) generating a data inversion signal using the arranged next data signal and a transmitted data signal applied to the data driver;

c) performing transition of the next data signal according to the data inversion signal, and transmitting the transition result to the data driver; and d) inverting the data inversion signal when the data inversion signal has a logic state successively maintained at least two times, and transmitting the transmitted data signal to the data driver wherein the step b) includes the steps of:

b1) detecting the presence or absence of transitions of the next data signal and transitions of the data signal;

b2) calculating the sum of the number of detected transitions;

b3) determining whether the sum value is higher than a reference value, and generating a detection signal according to the determined result;

b4) determining whether a logic state of the detection signal is continuously maintained at least two times using the detection signal, and generating a check signal according to the determined result; and b5) generating the data inversion signal according to the detection signal and the check signal.

8. The method according to claim 7, wherein the reference value is equal to half of a total number of overall bits of the data signal.

9. The method according to claim 7, wherein the step b4) includes the steps of:

delaying the detection signal according to the clock signal, and generating a first delay signal;

delaying the first delay signal according to the clock signal, and generating a second delay signal;

performing an XOR operation between the first delay signal and the detection signal, and outputting a first XOR operation signal;

performing an XOR operation between the second delay signal and the detection signal, and outputting a second XOR operation signal; and performing a NAND operation between the first XOR operation signal and the second XOR operation signal, and generating the check signal.

10. The method according to claim 7, wherein the step b5) includes the step of:

performing an AND operation between the detection signal and the check signal.

11. The method according to claim7, wherein the step a) includes the step of:

dividing the arranged data signal into odd and even data signals, and arranging the odd and even data signals.

* * * * *